US007843397B2

(12) United States Patent
Boyle

(10) Patent No.: US 7,843,397 B2
(45) Date of Patent: Nov. 30, 2010

(54) TUNING IMPROVEMENTS IN "INVERTED-L" PLANAR ANTENNAS

(75) Inventor: Kevin R. Boyle, Horsham (GB)

(73) Assignee: EPCOS AG, Munich (DE)

( * ) Notice: Subject to any disclaimer, the term of this patent is extended or adjusted under 35 U.S.C. 154(b) by 388 days.

(21) Appl. No.: 10/565,928

(22) PCT Filed: Jul. 16, 2004

(86) PCT No.: PCT/IB2004/002369

§ 371 (c)(1),
(2), (4) Date: Jan. 20, 2006

(87) PCT Pub. No.: WO2005/011055

PCT Pub. Date: Feb. 3, 2005

(65) Prior Publication Data

US 2008/0055174 A1 Mar. 6, 2008

(30) Foreign Application Priority Data

Jul. 24, 2003 (GB) ..... 0317305.1

(51) Int. Cl.
*H01Q 9/00* (2006.01)

(52) U.S. Cl. ..... 343/745; 343/700 MS

(58) Field of Classification Search ..... 343/700 MS, 343/702, 745

See application file for complete search history.

(56) References Cited

U.S. PATENT DOCUMENTS 4,827,266 A * 5/1989 Sato et al. ..... 343/700 MS
6,236,368 B1 * 5/2001 Johson ..... 343/702
6,255,994 B1 * 7/2001 Saito ..... 343/700 MS
6,466,170 B2 10/2002 Zhou
6,466,176 B1 10/2002 Maoz et al.
6,549,169 B1 4/2003 Matsuyoshi et al.
6,614,398 B2 9/2003 Kushihi et al.
6,873,291 B2 3/2005 Aoyama et al.
6,882,317 B2 * 4/2005 Koskiniemi et al. ... 343/700 MS
2002/0044092 A1 * 4/2002 Kushihi ..... 343/702
2003/0006936 A1 1/2003 Aoyama et al.
2003/0071763 A1 4/2003 McKinzie, III et al.
2003/0098813 A1 5/2003 Koskiniemi et al.

(Continued)

FOREIGN PATENT DOCUMENTS

CN 1407832 A 4/2003

(Continued)

OTHER PUBLICATIONS

Lui, G. K. H., et al., "Compact Dual-Frequency PIFA Designs Using LC Resonators," IEEE Transactions on Antennas and Propagation, vol. 49, No. 7, Jul. 2001, pp. 1016-1019.

(Continued)

*Primary Examiner*—Douglas W Owens
*Assistant Examiner*—Dieu Hien T Duong
(74) *Attorney, Agent, or Firm*—Slater & Matsil, L.L.P.

(57) ABSTRACT

A communications apparatus, includes a housing (40) containing a printed circuit board (PCB) (12) having a ground plane (16) and electronic components in rf shields (18) thereon. A planar antenna (10) is mounted spaced from the ground plane and a dielectric (14) is present in a space between the PCB and the planar antenna. A feed (36) couples the planar antenna (10) to the rf components.

20 Claims, 5 Drawing Sheets

U.S. PATENT DOCUMENTS

| | | | | |
|---|---|---|---|---|
| 2003/0146873 | A1 | 8/2003 | Blancho | |
| 2003/0174092 | A1* | 9/2003 | Sullivan et al. | 343/702 |

FOREIGN PATENT DOCUMENTS

| | | | |
|---|---|---|---|
| CN | 1423368 | A | 6/2003 |
| EP | 1 256 998 | A2 | 11/2002 |
| EP | 1 267 441 | A2 | 12/2002 |
| JP | 1-245705 | | 9/1989 |
| JP | 3-113516 | | 11/1991 |
| JP | 11-251825 | | 9/1999 |
| JP | 2001-189615 (A) | | 7/2001 |
| JP | 2003-92510 | A | 3/2003 |
| WO | WO 02/05384 | A1 | 1/2002 |
| WO | WO 02/11236 | A1 | 2/2002 |
| WO | WO 02/27865 | A1 | 4/2002 |
| WO | WO 02/080306 | A1 | 10/2002 |
| WO | WO 03/007425 | A1 | 1/2003 |

OTHER PUBLICATIONS

Tarvas, S., et al., "An Internal Dual-Band Mobile Phone Antenna," IEEE Antennas and Propagation Society International Symposium, vol. 1, 2000, pp. 266-269.

Koizumi, "Method of Desiging Filter for High-Frequency Band," Transistor Gijutsu Magazine, Feb. 1988, pp. 403-412.

* cited by examiner

TUNING IMPROVEMENTS IN "INVERTED-L" PLANAR ANTENNAS

This application is a 371 of PCT/IB2004/02369, which was filed on Jul. 16, 2004, which claims priority to Great Britain application 0317305.1, filed Jul. 24, 2003.

The present invention relates to improvements in or relating to planar antennas, particularly, but not exclusively, to dual band antennas for use in portable telephones. Such telephones may operate in accordance with the GSM and DCS 1800 standards.

PIFAs (Planar Inverted-F Antennas) are used widely in portable telephones because they exhibit low SAR (Specific Adsorption Ratio) which means that less transmitted energy is lost to the head and they are compact which enables them to be installed above the phone circuitry thereby using space within the phone housing more effectively.

Figure 1:
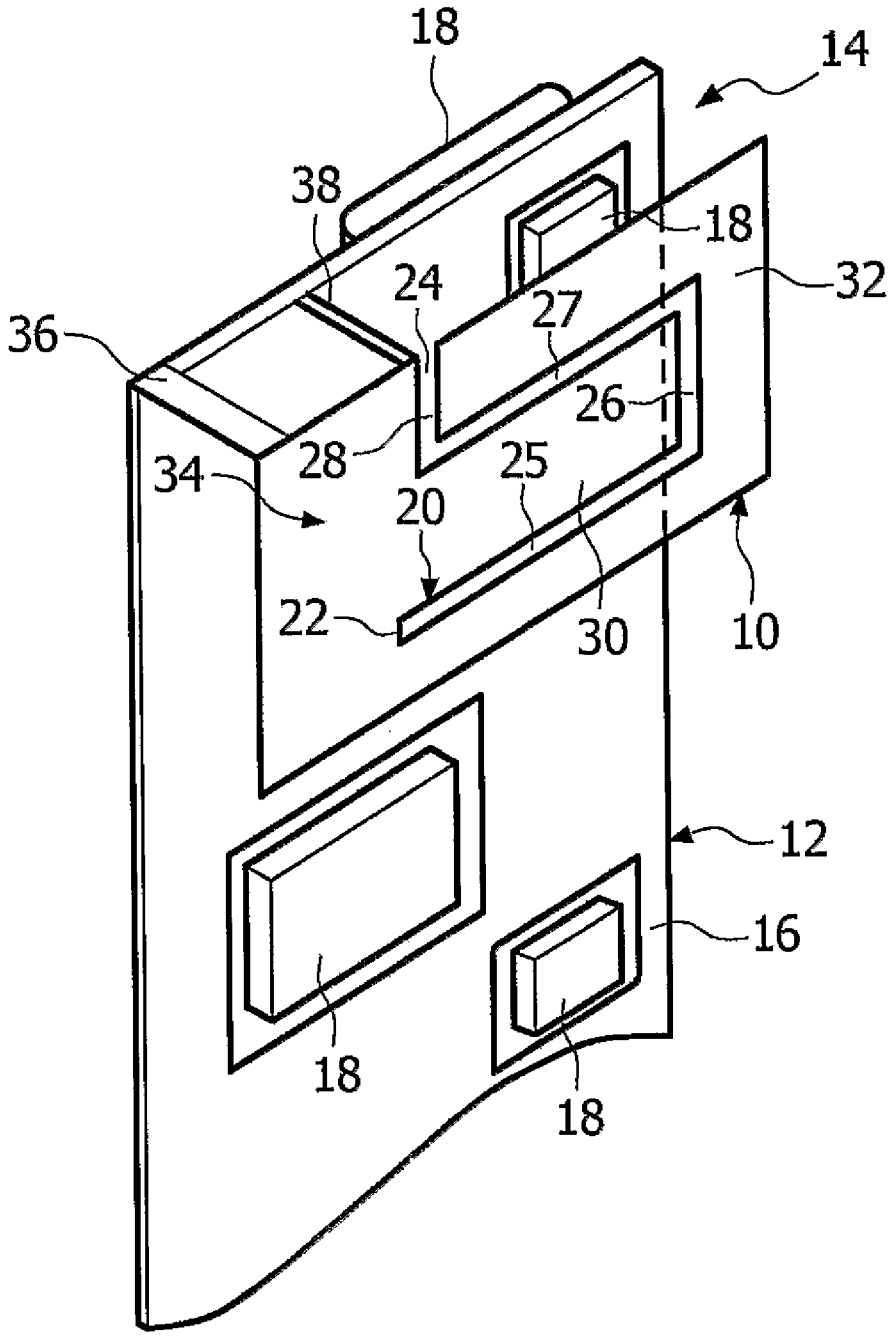
FIG. 1 (PRIOR ART)

A perspective diagrammatic view of a PIFA 10 is shown in FIG. 1 of the accompanying drawings. The PIFA 10 is separated from a printed circuit board (PCB) 12 by a dielectric 14 which in the illustrated example is air. Typically electronic components in RF shields (otherwise called rf cans) 18 are mounted on both sides of the PCB 10 and an electrically conductive ground plane 16 surrounds these components and covers the remaining area of the PCB 12.

The PIFA 10 comprises a patch having a slot 20, one end 22 of which is closed and the other end 24 of which opens into the upper edge of the patch. The slot itself comprises four interconnected rectilinear sections 25, 26, 27 and 28 extending orthogonally with respect each other. The slot 20 divides the patch into a central area 30 and a generally U-shaped area 32 which surrounds the central area 30. Both areas extend from a common base area 34. A feed tab 36 is connected at one end to a corner of the base area 34 and at its other end it is connected to components (not shown) mounted on the PCB 12. A shorting tab 38 is connected at one end to a corner of the base area 34 and the open end of the slot 20 and at its other end it resiliently contacts the ground plane 16.

The conventional view of structures such as that shown in FIG. 1 is that dual band operation is achieved by incorporating low frequency and high frequency resonators, namely the element formed by the central area 30 and the element formed by the U-shaped area 32, respectively, in the same structure. The slot 20 is considered to separate these resonators, while allowing a common feed point 36.

A perceived drawback of mounting PIFAs inside the housings of portable telephones and locating them just under the outer cover is that they are very susceptible to detuning by a person holding the telephone. The detuning appears to be associated with the antenna and the PCB or with the slot.

An object of the present invention is to mitigate the problem of detuning the antenna by the user.

According to a first aspect of the present invention there is provided a planar antenna assembly comprising a printed circuit board (PCB) having a ground plane and RF circuitry thereon, a patch antenna, means for mounting the patch antenna such that it is spaced from the ground plane, and a feed for coupling the patch antenna to the RF circuitry, the feed comprising components for reactively tuning the antenna by tuning a relatively lower frequency inductively and a relatively higher frequency capacitively.

According to a second aspect of the present invention there is provided a communications apparatus comprising a housing containing a printed circuit board (PCB) having a ground plane and RF circuitry thereon, a planar antenna spaced from the ground plane, a dielectric between the PCB and the planar antenna, and a feed coupling the planar antenna to the RF circuitry, the feed comprising components for reactively tuning the antenna by tuning a relatively lower frequency inductively and a relatively higher frequency capacitively.

According to a third aspect of the present invention there is provided a RF module comprising a printed circuit board (PCB) having a ground plane and RF circuitry thereon, a planar antenna spaced from the ground plane, a dielectric in a space between the PCB and the planar antenna, and a feed coupling the planar antenna to the RF circuitry, the feed comprising components for reactively tuning the antenna by tuning a relatively lower frequency inductively and a relatively higher frequency capacitively.

The present invention is based on an alternative view of dual band operation of slotted PIFAs. This alternative view is that a PIFA of the type shown in FIG. 1 has a single resonance between the two required frequencies. Dual band behaviour is achieved by reactive tuning of the slot, which acts approximately (dependent on the antenna size) as a quarter-wave transmission line close to the resonant frequency of the antenna. This alternative view shows that the slot can be replaced by discrete or distributed component(s), for example a parallel tuned L-C circuit, transmission line or any other predominantly reactive network, for example a filter, that is (or are) located on a part of the antenna structure that is not subject to detuning by the user holding the portable phone.

Figure 2:
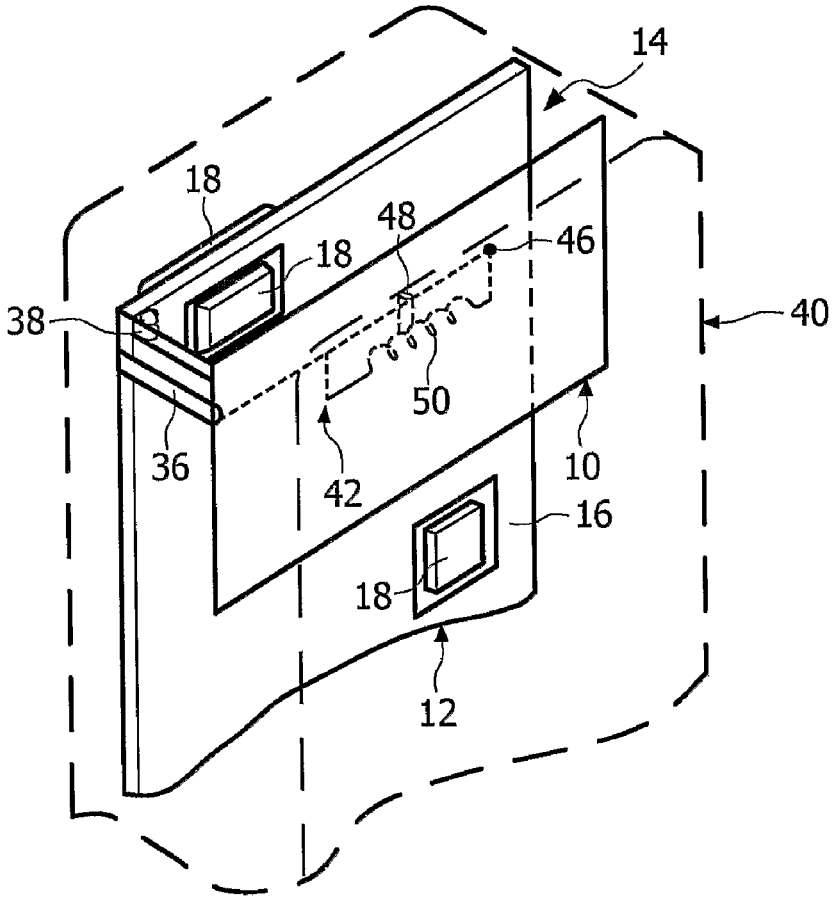
Figure 3:
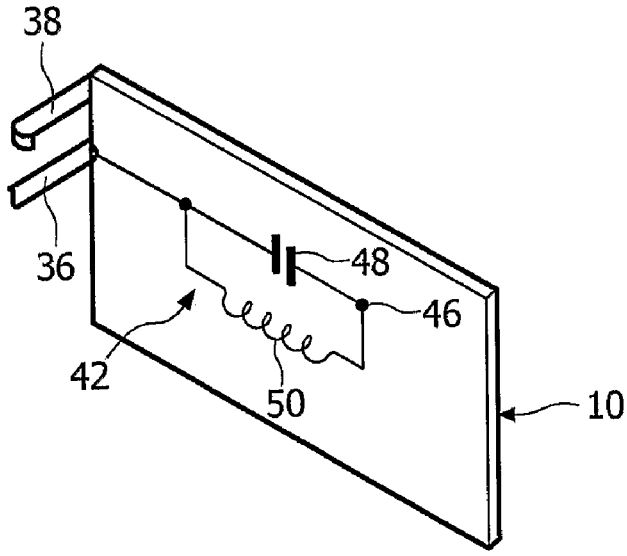
Figure 4:
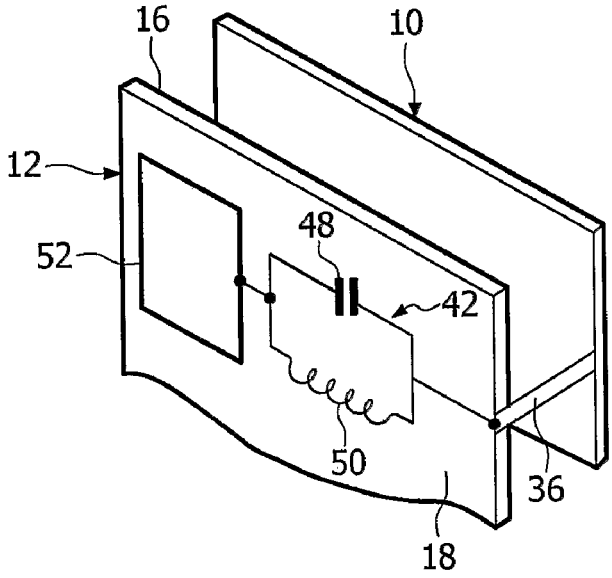
Figure 5:
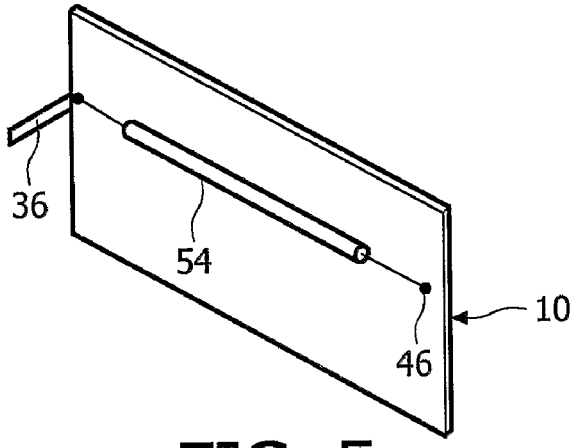
Figure 6:
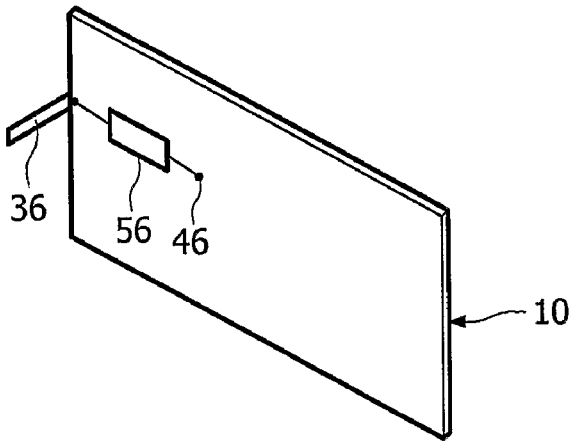
Figure 7:
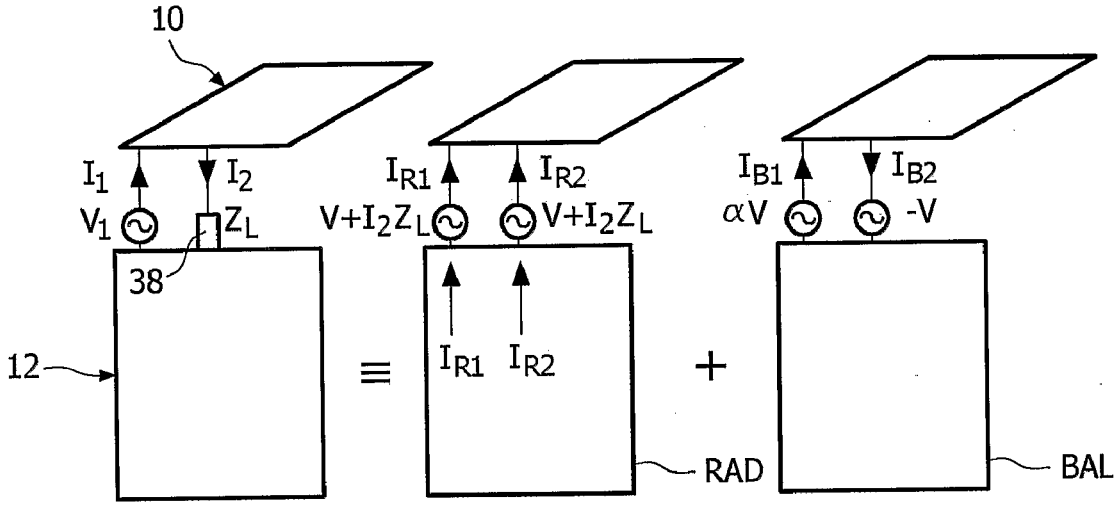
Figure 8:
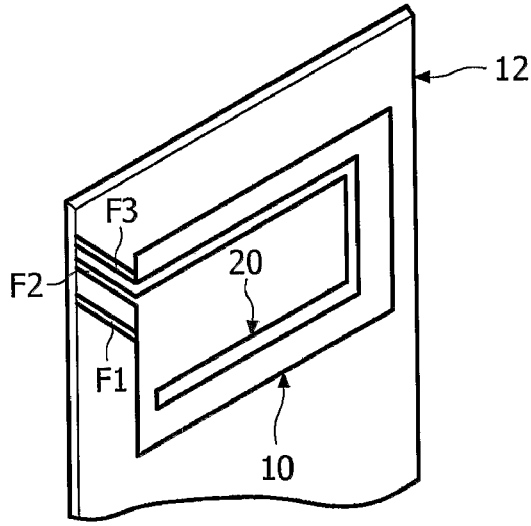
Figure 9:
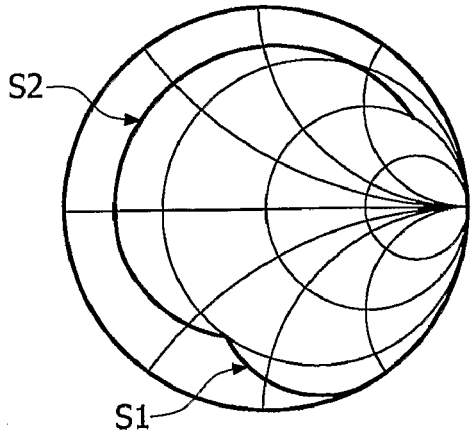
Figures 10, 11:
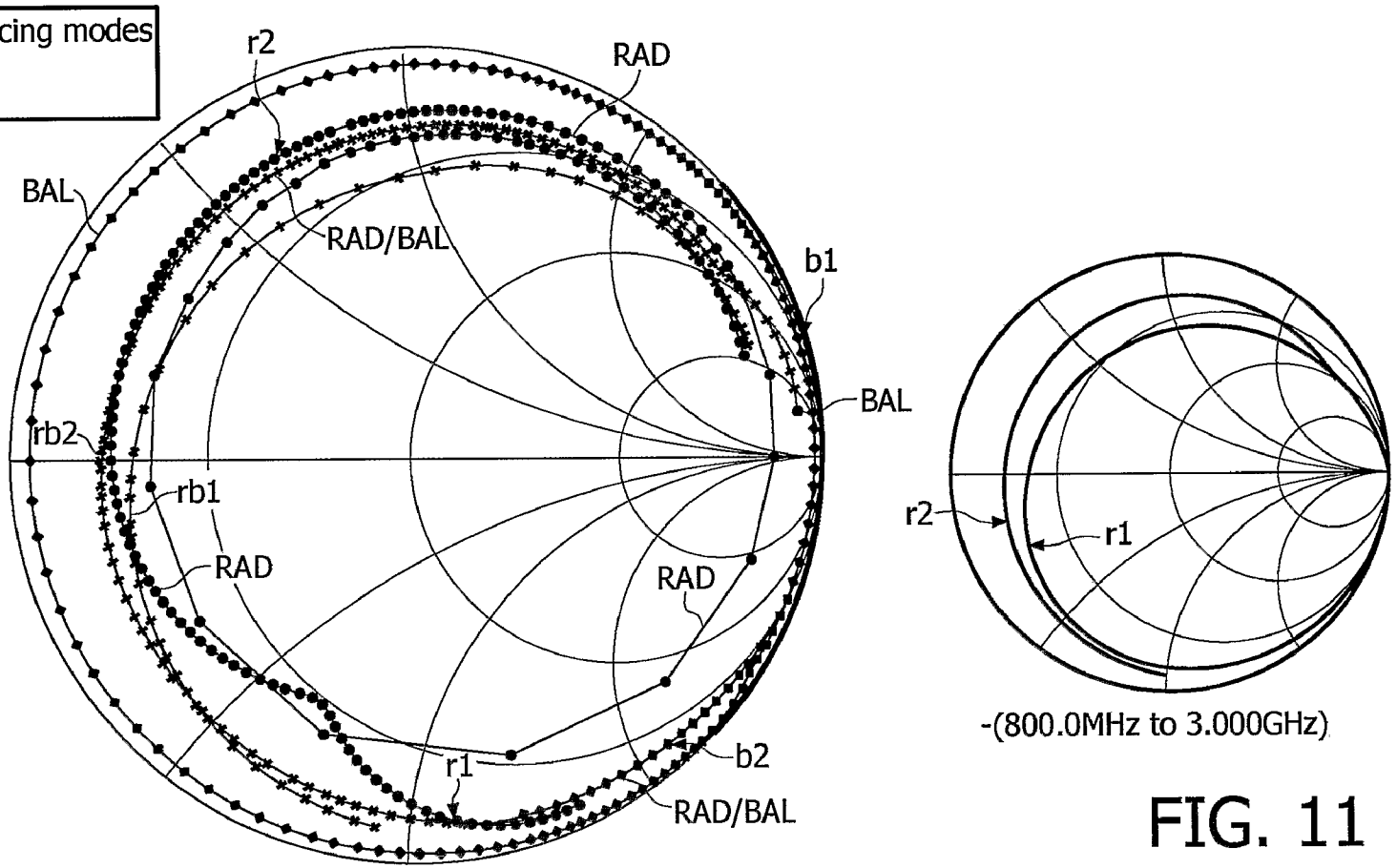

The present invention will now be described, by way of example, with reference to the accompanying drawings, wherein:

FIG. 1 is a perspective diagrammatic view of a slotted PIFA,

FIG. 2 is a perspective view of a portable communications apparatus made in accordance with the present invention, FIG. 3 is a diagrammatic perspective view of the reverse side of a planar antenna in which the feed includes a series connected parallel L-C circuit, FIG. 4 is a diagrammatic perspective view of a PCB and PIFA in which a parallel L-C circuit is connected in series with the output of the RF circuitry, FIG. 5 is a diagrammatic perspective view of the reverse side of a planar antenna in which the feed includes a transmission line, FIG. 6 is a diagrammatic perspective view of the reverse side of a planar antenna in which the feed includes a reactive network in the form of a filter, FIG. 7 is a diagram of a PIFA and PCB with a loaded shorting pin and its equivalent radiating and balanced mode representations, FIG. 8 is a perspective diagrammatic view of a tri-fed PIFA, FIG. 9 is a $S_{11}$ plot of a PIFA configuration shown in FIG. 8 without the slot and with equal feeds, FIG. 10 is a $S_{11}$ plot of the PIFA configuration shown in FIG. 8 in the open radiating, balanced and sum modes, and FIG. 11 is a $S_{11}$ plot of the PIFA configuration shown in FIG. 8 with the feeds 1 and 2 being cophased and the feed 3 removed.

In the drawings the same reference numerals have been used to indicate corresponding features.

As FIG. 1 has been described in the preamble of this specification it will not be repeated here.

FIGS. 2 and 3 illustrate a portable communications apparatus, such as a portable radiotelephone, comprising a housing 40 which contains a PIFA 10 coupled by a feed tab 36 to the RF circuitry (not shown) mounted on the PCB 12. A shorting tab 38 resiliently contacts the ground plane 16 on the PCB 12. The shorting tab 38 performs an impedance transformation. A parallel LC circuit 42 mounted on the reverse side of the antenna or a substrate carrying the antenna is connected in series between the feed tab 36 and a feed through pin 46 on the planar antenna. In practice the feed through pin 46 would be close to the feed pin 36 in order not to affect the operation of the antenna 10. The values of the inductance 50 and capacitance 48 of the circuit are selected to reactively tune the antenna. In the case of a dual band antenna for say GSM and DCS frequencies, the lower, GSM frequency is tuned inductively and the higher, DCS frequencies are tuned capacitively. The inductance 50 and capacitance 48 may be discrete or distributed components.

FIG. 4 illustrates a first variant of the embodiment shown in FIGS. 2 and 3 in which antenna 10 is a PIFA and the parallel LC circuit 42 is mounted on the surface of the PCB 12 remote from the antenna 10 and is connected between a RF block circuit 52 and the feed tab 36. A shorting tab 38 is not required in this implementation as its impedance transforming function is replaced by impedance transforming circuitry in RF circuit block 52.

FIG. 5 illustrates a second variant of the embodiment shown in FIGS. 2 and 3 in which a length of transmission line 54 is mounted on the reverse side of the antenna 10 which in this embodiment is a PILA (Planar Inverted L Antenna). The transmission line 54 is used to reactively tune the antenna. The transmission line 54 may also be provided on the PCB 12 to connect the RF circuit to the feed tab 36. In practice the pin 46 would be close to the feed tab 36.

FIG. 6 illustrates a third variant in which any other predominantly reactive network 56, such as a filter, is mounted on the reverse side of the PILA 10 and is used to reactively tune the antenna. The network 56 may also be provided on the PCB 12 to connect the rf circuit to the feed tab 36. In practice the pin 46 would be close to the feed tab 36.

In order to justify the alternative view of dual band operation of slotted PIFAs the following theoretical explanation will be given with reference to FIG. 7 of the accompanying drawings. FIG. 7 shows a PIFA 10 and a PCB 12 with a loaded shorting tab 38 and its equivalent Radiating mode RAD and Balanced mode BAL representations.

A load can be incorporated in the radiating mode analysis by replacing it with a voltage source of the same magnitude and polarity as the voltage drop across the load.

The input current, $I_1$ is given by $$I_1 = I_{R1} + I_B = \frac{V'}{(1+\alpha)Z_R} + \frac{V(1+\alpha)}{Z_B} \tag{1}$$

where $\alpha$ is the current sharing factor $I_{R2}/I_{R1}$ and the radiating mode voltage is given by $$V' = V + I_2 Z_L = V + (I_B - \alpha I_{R1}) Z_L \tag{2}$$

Using the two terms in equation (1) this gives $$V' = V + \frac{V(1+\alpha)}{Z_B} Z_L - \frac{\alpha V'}{(1+\alpha)Z_R} Z_L \tag{3}$$

Grouping terms in V and V' yields $$V'\left(1 + \frac{\alpha Z_L}{(1+\alpha)Z_R}\right) = V\left(1 + \frac{(1+\alpha)}{Z_B} Z_L\right) \tag{4}$$

Simplifying gives $$V' = V\frac{(1+\alpha)Z_R Z_B + (1+\alpha)^2 Z_R Z_L}{(1+\alpha)Z_R Z_B + \alpha Z_L Z_B} \tag{5}$$

Thus, a relation is established between the radiating and the balanced mode voltages. A relation can also be derived for the input voltage, $V_1$, which is given by $$V_1 = V' + \alpha V \tag{6}$$

Substituting (5) in (6) and simplifying gives $$V_1 = V\frac{(1+\alpha)^2 Z_R (Z_L + Z_B) + \alpha^2 Z_L Z_B}{(1+\alpha)Z_R Z_B + \alpha Z_L Z_B} \tag{7}$$

The input current can be found from (1) and (5) and is given by $$I_1 = V\frac{Z_B + (1+\alpha)Z_L}{(1+\alpha)Z_R Z_B + \alpha Z_L Z_B} + \frac{V(1+\alpha)}{Z_B} \tag{8}$$

Simplifying yields $$I_1 = V\frac{(1+\alpha)^2 (Z_L + Z_R) + Z_B}{(1+\alpha)Z_R Z_B + \alpha Z_L Z_B} \tag{9}$$

The ratio of equations (7) and (9) gives the impedance directly, since both equations have the same denominator.

$$Z_1 = \frac{(1+\alpha)^2 Z_R (Z_L + Z_B) + \alpha^2 Z_L Z_B}{(1+\alpha)^2 (Z_L + Z_R) + Z_B} \tag{10}$$

Setting $Z_L = \infty$ gives $$Z_1 = Z_R + \left(\frac{\alpha}{1+\alpha}\right)^2 Z_B \tag{11}$$

The balanced mode impedance is transformed down (or not at all for a very large current sharing factor) and adds in series with the radiating mode.

This result can be used to explain the operation of slots in the top plate, particularly when the opening is adjacent and close to the feed.

By way of example consider the geometry shown in FIG. 8, the illustrated antenna 10 has three feeds Fl, F2, F3. The feed F3 and its associated pin are "dummy" elements for the purposes of studying the effect of the slot 20. In the final design they would be removed. In this example the dimensions of the PCB 12 are 100×40×1 mm and those of the antenna 10 are 30×20×8 mm.

FIG. 9 shows the response of a PILA of the same dimensions but without the slot 20. This is achieved by applying equal amplitude, co-phased signals to each of the feeds F1, F2 and F3. The $S_{11}$ plot covers the frequency band of 800.00 MHz to 3.0 GHz and the markers S1 and S2 indicate the GSM900 and DCS1800 centre frequencies respectively. The response is as expected of a PILA on a PCB of the dimensions given.

The impedance of a PIFA with an open circuit load is given by the equation (11). This can be used to simulate the effect of the slot in the top plate of the antenna 10.

The analysis starts by connecting the feeds F1 and F2 together and applying common and differential voltages to feeds F1 and F2 (together) and to the feed F3. Then equation (11) is used to simulate the condition where the feed F3 is open circuit by way of the summation of the radiating and balanced modes. The resulting $S_{11}$ for all modes is shown in FIG. 10. The $S_{11}$ for the Radiating+Balanced modes is shown using "x" and is referenced RAD/BAL, the Balanced mode has been shown using "◆" and is referenced BAL and the Radiating mode has been shown using "●" and is referenced RAD. In FIG. 10 the various markers are as follows:

r1 radiating mode, $Z_R$ at GSM centre frequency
r2 radiating mode, $Z_R$ at DCS centre frequency
b1 balanced mode, $Z_B$ at GSM centre frequency
b2 balanced mode, $Z_B$ at DCS centre frequency
rb1 summation of radiating and balanced modes (including $K_{\alpha o}$ multiplication) at GSM centre frequency
rb2 summation of radiating and balanced modes (including $K_{\alpha o}$ multiplication) at DCS centre frequency At GSM and DCS frequencies the radiating mode impedance is close to that of a PILA without a slot, indicating that the slot has little effect on the radiating mode at these frequencies. There is, however, some effect at higher frequencies.

In the balanced mode the slot simply acts as a reactance, that is, a short circuit transmission line.

It can be seen from FIG. 10 that the slot length and the current sharing factor have been optimised such that the summation (series connection) of the radiating and balanced modes gives resonance at both GSM and DCS frequencies. This requires a long slot, partly because the antenna is slightly smaller than is usual.

FIG. 11 shows the $S_{11}$ when the feed F3 (FIG. 8) and its associated pin are removed (as they would be in the final design). It is observed that the length of the balanced mode transmission line is shortened somewhat, increasing the resonant frequencies, but otherwise the response is nominally the same.

The foregoing analysis gives a new insight into the behaviour of dual-band PIFAs. The antenna does not operate as two connected resonators but as a single resonator that is series reactively tuned by a short circuit transmission line.

This transmission line can be replaced by a parallel L-C resonator, as shown FIGS. 2 to 4, without fundamentally changing the operation of the antenna. Also since the slot is subject to detuning, for example, when a user puts a finger across the antenna 10 (as very often happens in practice), it is advantageous to use a discrete circuit, which will suffer little or no user interaction.

As shown in FIG. 6 the transmission line can also be replaced by any other predominantly reactive network 56.

The present invention is applicable to dual band antennas having a slot replaced by a resonator and to single band antennas in which the slot is replaced by a simple inductance.

In the present specification and claims the word "a" or "an" preceding an element does not exclude the presence of a plurality of such elements. Further, the word "comprising" does not exclude the presence of other elements or steps than those listed.

From reading the present disclosure, other modifications will be apparent to persons skilled in the art. Such modifications may involve other features which are already known in the design, manufacture and use of planar antennas and component parts therefor and which may be used instead of or in addition to features already described herein. Although claims have been formulated in this application to particular combinations of features, it should be understood that the scope of the disclosure of the present application also includes any novel feature or any novel combination of features disclosed herein either explicitly or implicitly or any generalisation thereof, whether or not it relates to the same invention as presently claimed in any claim and whether or not it mitigates any or all of the same technical problems as does the present invention. The applicants hereby give notice that new claims may be formulated to such features and/or combinations of such features during the prosecution of the present application or of any further application derived therefrom.

The invention claimed is:

1. A planar antenna assembly for use in two different frequency bands, the planar antenna assembly comprising:

a printed circuit board having a ground plane and RF circuitry thereon;

a patch antenna spaced from the ground plane, the patch antenna not having any slot;

a feed for coupling the patch antenna to the RF circuitry, the feed comprising components that are physically attached to a main surface of the patch antenna, the components for reactively tuning the patch antenna by tuning a first frequency inductively and a second frequency capacitively, the first frequency being lower than the second frequency, wherein the components comprise an inductive element and a capacitive element electrically connected to the patch antenna at two different points, the inductive element being electrically connected between the two points and the capacitive element being electrically connected between the two points in parallel with the inductive element; and a shorting tab electrically connected between the ground plane and the patch antenna, wherein the shorting tab electrically connects to the patch antenna adjacent to a connection point of the feed, the shorting tab performing an impedance transformation.

2. The antenna assembly as claimed in claim 1, wherein the components comprise a series connected, parallel L-C network.

3. The antenna assembly as claimed in claim 1, wherein the components are physically located between the patch antenna and the ground plane.

4. A communications apparatus comprising:

a housing;

a printed circuit board (PCB) within the housing, the printed circuit board having a ground plane and RF circuitry disposed thereon;

a planar antenna within the housing spaced from the ground plane, the planar antenna not having any slot;

a dielectric between the PCB and the planar antenna; and a feed coupling the planar antenna to the RF circuitry, the feed comprising components that are physically attached to a main surface of the planar antenna, the components for reactively tuning the planar antenna by tuning a first frequency inductively and a second frequency capacitively, the first frequency being lower than the second frequency, wherein the components comprise an inductive element and a capacitive element that are electrically connected to the planar antenna at two different points, the inductive element being electrically connected between the two points and the capacitive element being electrically connected between the two points in parallel with the inductive element; and a shorting tab electrically connected between the ground plane and the planar antenna, wherein the shorting tab electrically connects to the planar antenna adjacent to a connection point of the feed, the shorting tab performing an impedance transformation.

5. The apparatus as claimed in claim 4, wherein the components are located adjacent the dielectric.

6. The apparatus as claimed in claim 4, wherein the planar antenna is a planar inverted-L antenna (PILA).

7. The apparatus as claimed in claim 4, wherein the components comprise a series connected, parallel L-C network.

8. The apparatus as claimed in claim 4, wherein the components further comprise a transmission line.

9. The apparatus as claimed in claim 4, wherein the dielectric is air.

10. The apparatus as claimed in claim 4, wherein the components are physically located between the planar antenna and the ground plane.

11. The apparatus as claimed in claim 4, wherein the components are surrounded by the dielectric.

12. An rf module comprising:

a printed circuit board (PCB) having a ground plane and RF circuitry thereon;

a planar antenna spaced from the ground plane, the planar antenna not having any slot;

a dielectric in a space between the PCB and the planar antenna; and a feed coupling the planar antenna to the RF circuitry, the feed comprising components that are physically attached to a main surface of the planar antenna, the components for reactively tuning the planar antenna by tuning a first frequency inductively and a second frequency capacitively, the first frequency being lower than the second frequency, wherein the components comprise an inductive element and a capacitive element electrically connected to the planar antenna at two different points, the inductive element being electrically connected between the two points and the capacitive element being electrically connected between the two points in parallel with the inductive element; and a shorting tab electrically connected between the ground plane and the planar antenna, wherein the shorting tab electrically connects to the planar antenna adjacent to a connection point of the feed, the shorting tab performing an impedance transformation.

13. The module as claimed in claim 12, wherein the components are located adjacent the dielectric.

14. The module as claimed in claim 12, wherein the components comprise a series connected, parallel L-C network.

15. The module as claimed in claim 12, wherein the dielectric is air.

16. The module as claimed in claim 12, wherein the components are physically located between the planar antenna and the ground plane.

17. The module as claimed in claim 12, wherein the components are surrounded by the dielectric.

18. A planar antenna assembly comprising:

a printed circuit board having a ground plane and RF circuitry thereon;

a planar antenna that it is spaced from the ground plane; and a feed for coupling the planar antenna to the RF circuitry, the feed comprising components for reactively tuning the planar antenna by tuning a first frequency inductively and a second frequency capacitively, the first frequency being lower than the second frequency, the components being physically attached to a main surface of the planar antenna, wherein the components comprise an inductive element and a capacitive element electrically connected to the planar antenna at two different points, the inductive element being electrically connected between the two points and the capacitive element being electrically connected between the two points in parallel with the inductive element; and a shorting tab electrically connected between the ground plane and the planar antenna, wherein the shorting tab electrically connects to the planar antenna adjacent to a connection point of the feed, the shorting tab performing an impedance transformation.

19. The antenna assembly as claimed in claim 18, wherein the components comprise a series connected, parallel L-C network.

20. The antenna assembly as claimed in claim 18, wherein the components are physically located between the planar antenna and the ground plane.

* * * * *